United States Patent [19]

Palte et al.

[11] 4,069,938

[45] Jan. 24, 1978

[54] RETURNABLE SHIPPING CONTAINER

[75] Inventors: Kenneth F. Palte; Joseph M. Kurtz, both of Ottawa, Ohio

[73] Assignee: GTE Sylvania Incorporated, Stamford, Conn.

[21] Appl. No.: 777,017

[22] Filed: Mar. 14, 1977

[51] Int. Cl.[2] ..... B65D 9/18; B65D 7/28; B65D 19/40

[52] U.S. Cl. ..... 217/13; 206/597; 206/599; 217/16; 220/4 F; 220/7; 220/8; 220/83

[58] Field of Search ..... 190/21, 22, 23; 206/599, 386; 220/4 F, 6, 7, 83, 1.5, 8; 217/12 R, 13, 16, 43 R, 43 A, 45, 48

[56] References Cited

U.S. PATENT DOCUMENTS

| | | | |
|---|---|---|---|
| 590,510 | 9/1897 | Bonta, Jr. | 217/16 |
| 1,431,813 | 10/1922 | Judd | 217/13 |
| 1,950,118 | 3/1934 | Lifton | 217/13 |
| 2,454,455 | 11/1948 | Irwin | 220/8 |
| 3,423,101 | 1/1969 | Boeye | 217/12 R |

*Primary Examiner*—William Price
*Assistant Examiner*—Allan N. Shoap
*Attorney, Agent, or Firm*—Thomas H. Buffton; Theodore D. Lindgren; Robert T. Orner

[57] ABSTRACT

A returnable shipping container includes top and bottom closure members each having inner indentations and an outer affixed metal member forming a peripheral slot with collapsible first and second body members formed to fit into the bottom and top slots and adjoining edges with aligned notches and tabs. A stabilizing insert fits into the indentations of the top and bottom closure members and the notches of the first and second body members.

12 Claims, 3 Drawing Figures

RETURNABLE SHIPPING CONTAINER

BACKGROUND OF THE INVENTION

In the telephone industry, electronic switching assemblies are normally shipped in corrugated paper boxes. The corrugated paper box is placed on a solid wooden pallet, an electronic switching assembly deposited therein, packing material surrounds the assembly, and the box is closed and affixed to the wooden pallet by metal stripping. Upon reaching a destination, the corrugated box and packing materials are disposed of and the wooden pallet set aside for further use.

Although the above-mentioned packaging and shipping materials have been and still are utilized in many applications, it has been found that such a technique does leave something to be desired in certain applications. More specifically, it has been found the single useage and discarding of the corrugated boxes is a most expensive form of shipping. Also, the cartons require expensive labor to assemble. Further, the corrugated boxes do not provide the protection for the contained product which is desired and appears to be wasteful of warehouse and shipping vehicle space.

OBJECTS AND SUMMARY OF THE INVENTION

An object of the present invention is to provide an enhanced shipping container. Another object of the invention is to provide an improved shipping container which is collapsible and forms a returnable package for all of the parts of the container. Still another object of the invention is to provide an improved shipping container with improved warehouse storage and shipping vehicle density capabilities.

These and other objects, advantages and capabilities are achieved in one aspect of the invention by a returnable shipping container having top and bottom closure members with inner indentations and an outer metal member forming a peripheral slot, first and second collapsible body members fitting the bottom and top slots with notches and tabs intermediate thereto, and stabilizing members fitting the indentations of the closure members and the notches of the body members.

PREFERRED EMBODIMENT OF THE INVENTION

For a better understanding of the present invention, together with other and further objects, advantages and capabilities thereof, reference is made to the following disclosure and appended claims in conjunction with the accompanying drawings.

Figure 1:
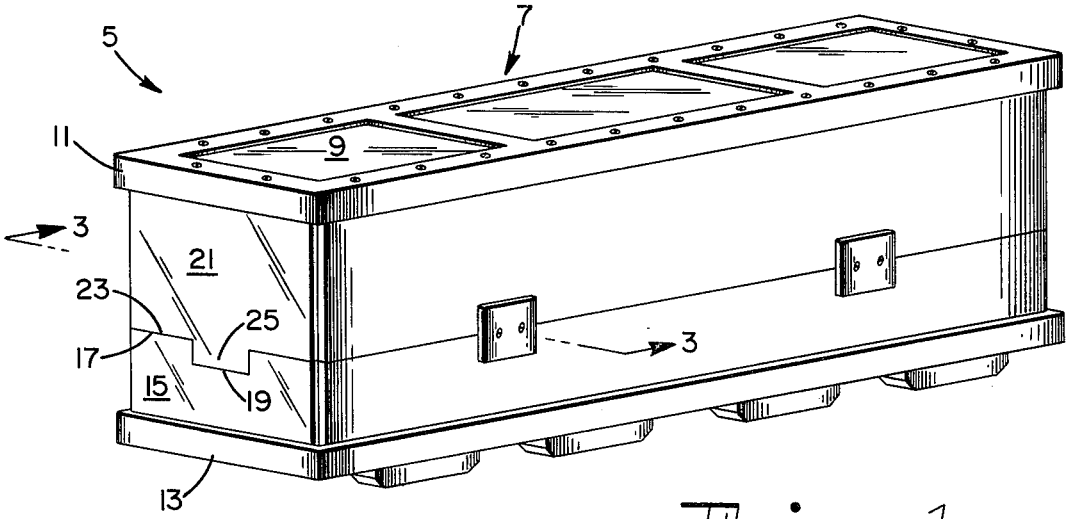
FIG. 1 is an isometric illustration of a preferred embodiment of the invention.

Referring to the drawings, FIG. 1 illustrated an isometric view of a preferred embodiment of the invention. Herein, a shipping container 5 includes a top closure member 7 with an inner closure member 9 having a perimeter surrounded by an affixed metal angle-iron-like member 11. Similarly, a bottom closure member (not shown) has an affixed metal angle-iron-like member 13.

A first collapsible body member 15 is formed for deposition in a slot intermediate the metal angle-iron-like member 13 and the bottom closure member (not shown). The first body member 15 has an upper edge 17 with a plurality of notches 19 therein. A second collapsible body member 21 has a lower edge 23 contacting the upper edge 17 of the first body member 15. The lower edge 23 of the second collapsible body member 21 has a plurality of tongue members 25 and notches (not shown). The upper edge of the second collapsible body member 21 is formed to fit into a slot intermediate the metal angle-iron-like member 11 and the perimeter of the outer surface 9 of the top closure member 7. A stabilizing insert (not shown) is utilized to ruggedize the shipping container 5.

Figure 2:
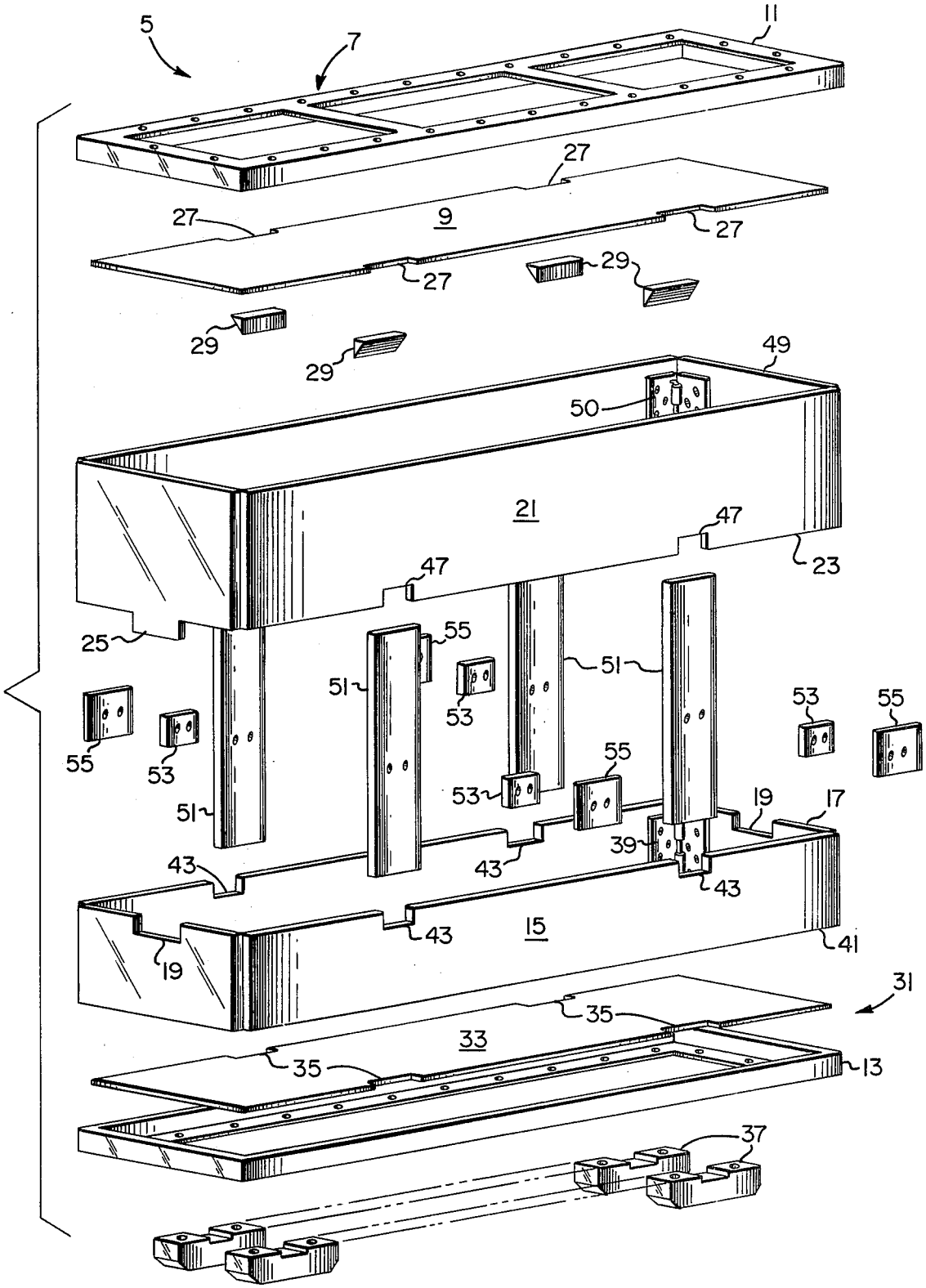
FIG. 2 is an exploded view of the preferred embodiment of FIG. 1.

More specifically, the exploded view of FIG. 2 illustrates a collapsible container 5 having a top closure member 7. The top closure member 7 has a substantially rectangular-shaped metal angle-iron-like member 11 which surrounds the perimeter of and is affixed to an inner closure member 9. The inner closure member 9 has a longitudinal axis with a pair of indentations 27 spaced along opposite sides of the longitudinal axis. A wedge-shaped member 29 is affixed to the inner closure member 9 immediately adjacent each one of the indentations 29 and serves as a guide member as will be explained hereinafter.

A bottom closure member 31 has a substantially rectangular-shaped metal angle-iron-like member 13 which is affixed to and surrounds the perimeter of an inner closure member 33. The inner closure member 33 has a longitudinal axis with a pair of indentations 35 spaced along opposite sides of the longitudinal axis. A plurality of slotted foot members 37 are affixed to the surface of the bottom closure member 31.

A collapsible first body member 15 is substantially rectangular-shaped with a hinge 39 located at each corner. The first body member 15 has a lower edge 41 formed to fit into a slot (not shown) intermediate the metal angle-iron-like member 13 and the perimeter of the inner closure member 33 of the bottom closure member 31. The first body member 15 also has an upper edge 17 with a plurality of notches 43 aligned with the indentations 27 and 35 of the top and bottom closure members 7 and 31. Also, the rectangular-shaped first body member 15 had a pair of ends each having a notch 19.

A collapsible second body member 21 is substantially rectangular-shaped with a hinge 51 located at each one of the corners. The second body member 21 has a lower edge 23 with a plurality of notches 47 therein aligned with the notches 43 of the first body member 15 and the indentations 27 and 35 of the top and bottom inner closure members 7 and 31. The second body member 21 also has a pair of tongue members 25 aligned with the notches 19 of the first body member 15. A top edge 49 of the second body member 21 is formed to fit into a slot (not shown) intermediate the angle-iron-like member 11 and the perimeter of the inner closure member 9.

A stabilizing insert 51 is aligned with each of the indentations 27 and 35 of the upper and lower inner closure members 7 and 31 and the notches 43 and 47 of the first and second body members 15 and 21. Each of the stabilizing inserts 51 has a first block member 53 affixed thereto with a second block member 55 attached to the first block member 53.

Figure 3:
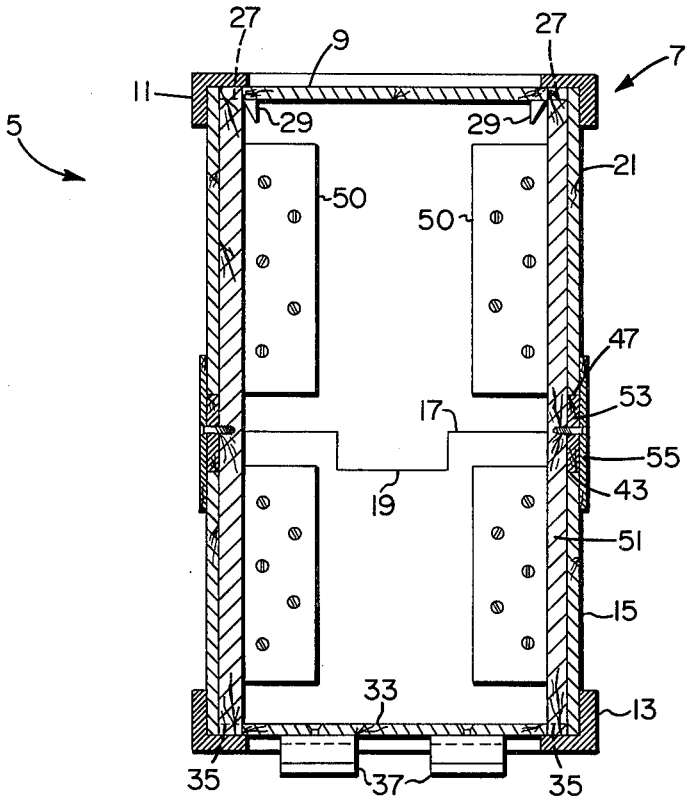
FIG. 3 is a cross-sectional view of the preferred embodiment of FIG. 1 taken along the line 3-3.

As to assembly of the container 5, reference is made to the cross-sectional view of FIG. 3 in conjunction with FIG. 2. Therein, the first body member 15 is fitted into a slot formed by the bottom angle-iron-like member 13 and the perimeter of the inner closure member 33. The stabilizing inserts 51 each have one end disposed in an indentation 35 of the bottom inner closure member 33. The first block member 53 fits into the notch 43 in the upper edge 17 of the first body member 15 while the second block member 55 overlaps the first block member 53 forming a slot for receiving the first and second body members 15 and 21.

The second body member 21 has a slot 47 on the lower edge 17 which is telescoped over the first block member 53 of the stabilizing insert 51. The second block member 53 and the stabilizing member 51 form a slot-like portion wherein the second body member 21 is retained. The top closure member 7 is placed on the second body member 21 in a manner such that the second body member 21 is guided into the slot formed by the metal angle-iron-like member 11 and the perimeter of the inner closure member 9. Moreover, the ends of the stabilizing inserts 51 are guided by the wedge-shaped members 29 into the indentations 27 of the top inner closure member 9.

Thus, an integrated package suitable for shipment of relatively heavy apparatus is provided. Also, the package is suitably held together by bonding wherein metal straps encircle the container and are restricted in lateral movement by the slotted foot members 37.

Further, the above-described container is readily collapsed by removal of the stabilizing members 51 and either activation of the hinge 50 or removal of the pins therein to render the second body member 21 in a collapsed condition. The second body member 21 and the stabilizing members 51 are deposited in the first body member 15 and the top closure member 7 is telescoped over the top edge 17 of the first body member 15. Thereupon, the metal angle-iron-like member 11 serves to cover the notches 43 and 45 of the first body member 15 and provide a sealed collapsed container.

Preferably, not necessarily, the top and bottom inner closure members 9 and 33, first and second body members 15 and 21, and stabilizing inserts 51 are of a ½-inch plywood or plastic material. Also, the angle-iron-like members 11 and 13 are preferably of a two-inch material formed to provide ½-inch slots for receiving the first and second body members 15 and 21.

Thus, there has been provided a unique collapsible container especially suitable to the shipment of relatively heavy apparatus. The container is formed to provide a maximum shipping density container especially suitable for storage without need for relatively expensive shelving and pallet arrangements. Moreover, the container is readily collapsed and packaged for return shipment re-use.

While there has been shown and described what is at present considered a preferred embodiment of the invention, it will be obvious to those skilled in the art that various changes and modifications may be made therein without departing from the invention as defined by the appended claims.

What is claimed is:

1. A returnable shipping container comprising:

top and bottom closure members having a longitudinal axis, an inner surface with a pair of indentations spaced along on opposite sides of said axis, and an outer surface with an affixed metal member forming a slot surrounding the perimeter of the closure members;

a first body member having a pair of side members and a pair of end members detachably affixed and normal thereto, said side and end members having a lower edge formed for reception by said slot of said bottom closure member with said side members having an upper edge with notches aligned with said indentations and said end members each having an upper edge with a notch;

a second body member having a pair of side members and a pair of end members detachably affixed and normal thereto, said side and end members having an upper edge formed for reception by said slot of said top closure member with said side members having a lower edge with a notch aligned with said indentations and said end members each having a tongue member aligned with said notch of said end member of said first body member; and a stabilizing insert for each of said indentations in one of said top and bottom closure members, said insert having opposite ends formed for reception by said indentations, a first block member affixed thereto and formed for compatable reception by a notch of said first and second body members and a second block member affixed to said first block member and forming a slot with said stabilizing insert for receiving said first and second body members.

2. The returnable shipping container of claim 1 wherein said closure members, body members, and stabilizing inserts are plywood.

3. The returnable shipping container of claim 1 wherein said closure members, body members, and stabilizing inserts are of plastic.

4. The returnable shipping container of claim 1 wherein said metal member affixed to said top and bottom closure members is in the form of angle iron.

5. The returnable shipping container of claim 1 including a plurality of foot members affixed to said outer surface of said bottom closure member, each foot member having a cut-out therein to provide an aperture intermediate said foot member and said outer surface of said closure member for capturing holding straps.

6. The returnable shipping container of claim 1 wherein said side and end member of said first and second body members are detachably affixed by hinges.

7. The returnable shipping container of claim 1 wherein said closure member, body member, and stabilizing inserts are of ½ inch material and said metal member is in the form of 2-inch angle iron spaced to from an ½-inch slot surrounding to perimeter of said top and bottom closure members.

8. A returnable shipping container comprising:

first and second body members each having a pair of side members and a pair of end members detachably affixed and normal to said side members, said first body member having a lower edge formed for reception by a slot and an upper edge with spaced notches in each side member and a notch in each end member and said second body member having an upper edge formed for reception by a slot and a lower edge with spaced notches in each side member aligned with said notches of said first body member and a tongue member in each end member aligned with said notches of said end members of said first body members;

top and bottom closure members each having an inner surface with indentations aligned with said notches of said first and second body members and an outer surface with a slot-forming member affixed thereto and spaced from the perimeter thereof to form a slot intermediate said closure member and said slot-forming members; and stabilizing inserts for each of said notches of one of said first and second body member, each of said inserts having opposite ends formed for insertion in said indentations of said top and bottom closure members, a first block member affixed thereto for insertion in said aligned notches of said first and second body members and a second block member affixed to said first block member and forming a slot for receiving said first and second body members.

9. The returnable shipping container of claim 8 wherein said slot forming member affixed to said top and bottom closure members is in the form of metal angle iron.

10. The returnable shipping container of claim 8 including a plurality of foot members affixed to said outer surface of said bottom closure members, each of said foot members having a cut-out portion to provide an aperture intermediate said foot member and said to outer surface of said closure member.

11. The returnable shipping container of claim 8 wherein hinge members detachably affix said side and end members of each of said first and second body members.

12. The returnable shipping container of claim 8 wherein said second body member is formed for collapse and disposed within said first body member and said top and bottom closure members whereby a returnable shipping container is provided.

* * * * *